US009266671B2

(12) United States Patent
Prescott et al.

(10) Patent No.: US 9,266,671 B2
(45) Date of Patent: Feb. 23, 2016

(54) APPARATUS AND METHOD FOR COMPRESSING TRASH

(76) Inventors: Sherley Louise Prescott, Kissimmee, FL (US); Robert A. Prescott, Kissimmee, FL (US)

( * ) Notice: Subject to any disclaimer, the term of this patent is extended or adjusted under 35 U.S.C. 154(b) by 639 days.

(21) Appl. No.: 13/699,738

(22) PCT Filed: May 25, 2011

(86) PCT No.: PCT/US2011/037979

§ 371 (c)(1),
(2), (4) Date: Feb. 2, 2013

(87) PCT Pub. No.: WO2011/150112

PCT Pub. Date: Dec. 1, 2011

(65) Prior Publication Data

US 2013/0206021 A1 Aug. 15, 2013

Related U.S. Application Data

(60) Provisional application No. 61/348,188, filed on May 25, 2010.

(51) Int. Cl.

| | |
|---|---|
| ***B30B 13/00*** | (2006.01) |
| ***B65F 1/14*** | (2006.01) |
| ***B30B 9/30*** | (2006.01) |
| ***B30B 1/00*** | (2006.01) |
| ***B65F 1/06*** | (2006.01) |
| ***B65D 43/26*** | (2006.01) |

(52) U.S. Cl.

CPC ..... *B65F 1/1405* (2013.01); *B30B 9/3053* (2013.01); *B30B 13/00* (2013.01); *B65D 43/262* (2013.01); *B65F 1/06* (2013.01); *B65F 1/163* (2013.01)

(58) Field of Classification Search

CPC .... B30B 9/3032; B30B 9/3053; B30B 13/00; B65F 1/1405; B65F 1/163; B65F 1/04; B65F 1/06; B65F 1/08; B65D 43/262

USPC ..... 100/35, 59, 61, 226, 227, 229 A, 240, 100/265, 266, 268; 220/262, 263, 578, 908, 220/908.1

See application file for complete search history.

(56) References Cited

U.S. PATENT DOCUMENTS

| | | | | |
|---|---|---|---|---|
| 2,465,839 A * | 3/1949 | Bloomfield | ..... | 100/226 |
| 3,736,863 A * | 6/1973 | Brucker | ..... | 100/228 |
| 5,179,895 A | 1/1993 | Bauer | | |
| 5,619,915 A | 4/1997 | Wagner et al. | | |

(Continued)

FOREIGN PATENT DOCUMENTS

| | | |
|---|---|---|
| EP | 2 014 582 A1 | 1/2009 |
| KR | 20-1996-0028885 U | 9/1996 |

(Continued)

*Primary Examiner* — Jimmy T Nguyen

(74) *Attorney, Agent, or Firm* — Gerald F. Dudding; GFD Patents LLC

(57) ABSTRACT

A trash container that allows the user to compress trash when the user manually pushes the top cover down. When an indoor trash container seems full, people would normally press the garbage down into the container using their hands in order to create more room inside the container. That is unsanitary. Our invention is a trash container that allows the user to compress trash when the user manually pushes the top cover down. A user's hands don't touch the trash.

26 Claims, 4 Drawing Sheets

(56) References Cited

U.S. PATENT DOCUMENTS

| | | | | |
|---|---|---|---|---|
| 5,845,567 | A | 12/1998 | Fischer | |
| 6,314,874 | B1 | 11/2001 | Martorella | |
| 6,851,357 | B1 | 2/2005 | Martorella et al. | |
| 6,983,685 | B2 * | 1/2006 | Ko | 100/227 |
| 7,237,480 | B2 | 7/2007 | Ruddock | |
| 7,299,746 | B2 | 11/2007 | LaPorte | |
| 7,536,949 | B2 | 5/2009 | Skannerup | |
| 7,874,446 | B2 * | 1/2011 | Spivey | 100/265 |
| 2004/0020927 | A1 | 2/2004 | Yang et al. | |
| 2010/0154663 | A1 | 6/2010 | Harari | |
| 2010/0181313 | A1 | 7/2010 | Turina | |
| 2011/0056393 | A1 | 3/2011 | Kachkovsky | |
| 2011/0174170 | A1 * | 7/2011 | Fritz | 100/35 |

FOREIGN PATENT DOCUMENTS

| | | | |
|---|---|---|---|
| KR | 20-0308577 | Y1 | 3/2003 |
| WO | 2005-005288 | A1 | 1/2005 |
| WO | 2009/010843 | A1 | 1/2009 |

* cited by examiner

APPARATUS AND METHOD FOR COMPRESSING TRASH

I. FIELD OF THE INVENTION

The present invention relates generally to an apparatus and method of compressing trash. More specifically, the present invention relates to a container having a cover and method for manually compressing the trash.

BACKGROUND OF THE INVENTION

Taking out the trash for most families is a daily chore. You know the routine. Everything your family has thrown away goes into a trash can. The average American family generates about four pounds of trash every day! That's 1,460 pounds of trash per person every year. Multiply that by the number of people living in the United States; and you'll realize that we, as a nation, throw away about 210 million tons of stuff each year. It comes from our homes, businesses, government agencies, and institutions like schools and hospitals. But where does it all go? About 27 percent of it is recycled or composted, and 16 percent is burned, but the majority (57 percent) is buried in landfills.

There is a need for improved methods and devices for economically storing buried trash in landfills.

SUMMARY OF THE INVENTION

A first aspect of the present invention provides an apparatus for compressing trash, comprising: a container having a liner; a lid comprising a first opening in a first surface opens into a bore through the lid, and a second opening in a second surface of the lid; a slidably displaceable compressing device, comprising: a radially depending top horizontal plate, a radially depending bottom horizontal plate, and an elongated member, therebetween, wherein the radially depending top horizontal plate is slidably displaceable inside the bore through the first surface of the lid of the container, wherein the radially depending bottom horizontal plate is slidably displaceable into the liner of the container, and wherein the elongated member is slidably displaceable along its longitudinal axis in the second opening in the second surface of the lid; a suspension device, for suspending the compressing device, coaxially disposed about the elongated member between the radially depending top horizontal plate and the second surface of the lid, wherein the suspension device suspends the slidably displaceable compressing device by generating opposing antiparallel forces substantially parallel to the longitudinal axis of the compressing device.

A second aspect of the present invention provides a method for hygienically compressing trash, comprising: providing an apparatus for compressing trash, comprising: a container having a liner; a lid comprising a first opening in a first surface opens into a bore through the lid, and a second opening in a second surface of the lid; a slidably displaceable compressing device, comprising: a radially depending top horizontal plate, a radially depending bottom horizontal plate, and an elongated member, therebetween, wherein the radially depending top horizontal plate is slidably displaceable inside the bore through the first surface of the lid of the container, wherein the radially depending bottom horizontal plate is slidably displaceable into the liner of the container, and wherein the elongated member is slidably displaceable along its longitudinal axis in the second opening in the second surface of the lid; a suspension device, for suspending the compressing device, coaxially disposed about the elongated member between the radially depending top horizontal plate and the second surface of the lid, wherein the suspension device suspends the slidably displaceable compressing device by generating opposing antiparallel forces substantially parallel to the longitudinal axis of the compressing device; and slidably displacing the compressing device to compress the trash without a user's hands physically coming in contact with the trash.

A third aspect of the present invention provides an apparatus for compressing trash, comprising: a container having a liner, wherein the liner contains trash; a lid, having a solid shape and comprising first and second surfaces, having first and second openings, therein, wherein the first and second surfaces, having first and second openings are oppositely disposed, wherein the first opening in the first surface opens into a bore through the lid, and wherein the second opening in the second surface opens into the container; a slidably displaceable compressing device, comprising: a radially depending top horizontal plate, a radially depending bottom horizontal plate, and an elongated member, therebetween, wherein the radially depending top horizontal plate is slidably displaceable into the bore of the lid, wherein the radially depending bottom horizontal plate is slidably displaceable into the liner of the container, and wherein the elongated member is slidably displaceable along its longitudinal axis in the second opening in the second surface of the lid; and a suspension device, for suspending the compressing device, coaxially disposed about the elongated member between the radially depending top horizontal plate and the second surface of the lid, wherein the suspension device suspends the longitudinally displaceable compressing device by generating opposing antiparallel forces substantially parallel to the longitudinal axis of the apparatus.

BRIEF DESCRIPTIONS OF THE FIGURES

The features of the invention are set forth in the appended claims. The invention itself, however, will be best understood by reference to the following detailed description of an illustrative embodiment when read in conjunction with the accompanying drawings, wherein:

DETAILED DESCRIPTION OF EMBODIMENTS OF THE INVENTION

Figure 1:
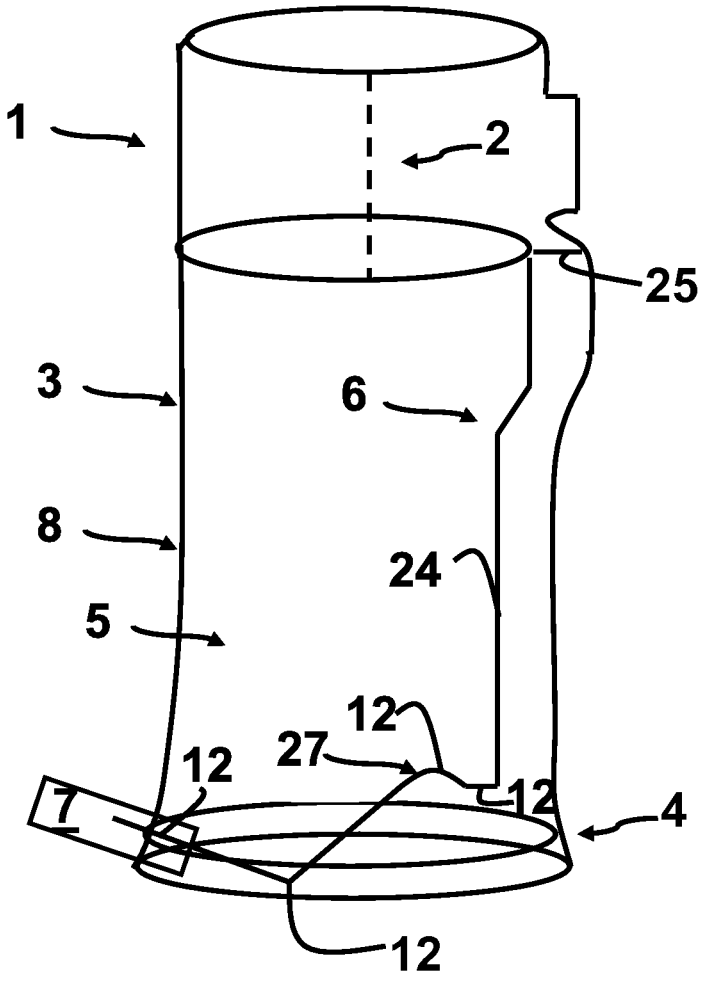
FIG. 1 depicts an elevation view of an apparatus for compressing trash, in accordance with embodiments of the present invention.
Figure 2:
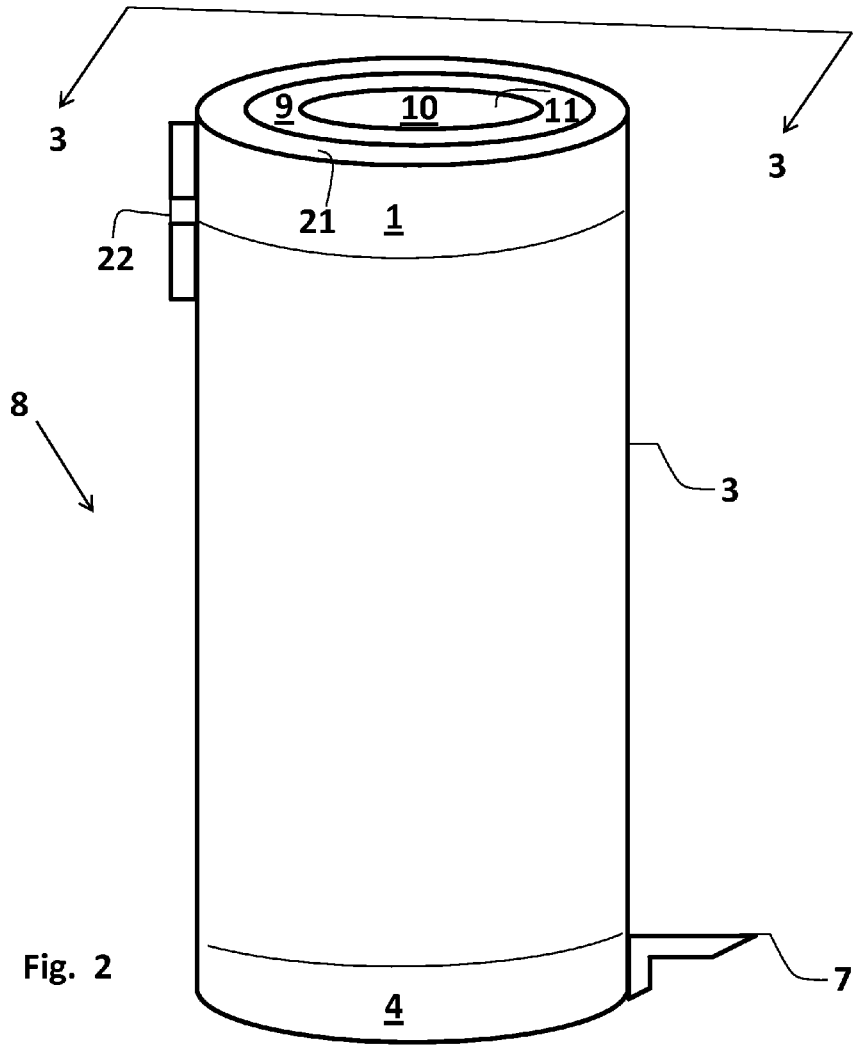
FIG. 2 depicts an elevation view of the an apparatus for compressing trash depicted in FIG. 1, showing a top horizontal plate in a bore of the lid, in accordance with embodiments of the present invention.

FIGS. 1-2 depict elevation views of an apparatus 8 for compressing trash, comprising: a lid 1, a compressing device 2, a container 3, a base 4, a liner 5, a lid-lifting device 6, and a pedal 7.

The apparatus 8 for compressing trash is a trash container that allows the consumer to compress trash by simply pushing the top cover down, creating space to add more trash. It isn't motor-driven, battery-operated or hydraulic. It may be 100% manual.

Problem to be Solved

Provide a simple, comfortable, modern, sanitary and convenient way of compressing every-day household garbage. When a trash can appears to be filling up, consumers would press down on the trash with their hands to condense it and create extra space for new trash. This process, however, is inconvenient and very unsanitary. While touching the trash, users may unknowingly pick up a multitude of harmful germs and bacteria. However, if the trash is not condensed, consumers may not be able to determine how much space is available in the can and they will take the trash out before it is full. Consumers would, then, spend more money on trash bags and unintentionally hurt our environment by having more unfilled trash bags in waste sites.

A first object of the present invention is to provide sanitary way of compressing every-day household garbage, because this product eliminates the need for users to physically touch trash during the compacting process. Also, the design minimizes odor because the lid stays closed while the consumer compresses the trash.

A second objective of the present invention is to provide economical use of trash container liners by assuring the liners are completely filled with trash before disposal in landfills.

A third objective of the present invention is to provide a user-friendly and simple to use apparatus for compacting trash, in which the top cover will slowly bring itself back up after compressing the trash.

A fourth objective of the present invention is to provide a trash compactor that is comfortable, modern and convenient for the user because the user does not see the trash while compressing it. Also, the height of the trash compactor does not require the user to bend over when depressing the lid to compress the trash, which makes it more comfortable and ergonomic. Also, a ridge around the perimeter of the lid provides a safety mound to protect fingers from going between the lid and the side of the container when compressing the trash.

A fifth objective of the present invention is to provide a durable trash compactor that may be used indoors or outdoors because the trash compactor is made of stainless steel or high strength and impact resistant plastic, e.g. fiber reinforced thermoplastic or thermoset composites.

A sixth objective of the present invention is to provide a simple, sanitary, user-friendly, convenient-to-use, manually operated trash compressing can, in contrast to compressing and compacting trash containers that are either motor-driven, hydraulically operated, modular (which requires assembly every time it is being used), have external plunger arms, have corrugated baffles, require you to insert your entire foot inside the container, require a compacting plate that pivots horizontally above and outside the container, or require a locking mechanism to hold the trash down inside the container. Those trash containers aren't user-friendly or convenient. They are complicated, heavy, bulky and unsanitary. The present invention is simple, ergonomic, user-friendly, sanitary and aesthetically pleasing. The compressing device allows you to compress trash when you manually push the top cover down. A simple spring coil coaxially disposed around the rod of the compressing device provides antiparallel forces which returns the top horizontal plate to a position flush with the opening in the lid after the bottom horizontal plate has compressed the trash. In one embodiment the present invention is only manually driven, not motor-driven or hydraulically operated.

In one embodiment, the apparatus 8 for compressing trash, comprises: a slidably displaceable compressing device 2, comprising: a radially depending top horizontal plate 10, a radially depending bottom horizontal plate 15, and an elongated member 14, therebetween, wherein the radially top horizontal plate 10 is slidably displaceable into a bore 9 through a first surface 21 of a lid 1 of a container 3, and wherein the radially depending bottom horizontal plate 15 is slidably displaceable into a liner 5 of the container 3, and wherein the elongated member 14 is slidably displaceable along its longitudinal axis in a second opening 18 in a second surface 28 of the lid 1; a suspension device 19, for suspending the compressing device 2, coaxially disposed about the elongated member 14 between the radially depending top horizontal plate 10 and the second surface 28 of the lid 1, wherein the suspension device 19 suspends the longitudinally displaceable compressing device 2 by generating opposing antiparallel forces substantially parallel to the longitudinal axis of the compressing device 2.

A second aspect of the present invention provides a method for hygienically compressing trash, comprising: providing the apparatus for compressing trash of claim 1; and slidably displacing the compressing device to compress the trash without a user's hands physically coming in contact with the trash.

The compressing device 2 comprises a top horizontal plate 10, that may be flush with a top surface 9 of the lid 1 when the compressing device 2 is fully expanded. The top surface 9 may be raised around the perimeter of the top horizontal plate 10, to provide a mound or ridge 11 for a user's fingers to grip during the compressing action in which a user may push the top horizontal plate 10 downward to compress the trash inside the container 3.

A portion 27 of the lid-lifting device 6 has a horizontal Z-shape and is attached to the center of the base 4 preferably (but not limited to) by four notches 12. One end of the portion 27 rests under an external pedal 7, and the other end of the portion 27 extends into vertical portion 24. The pedal 7 is attached to the container 3 preferably (but not limited to) by two small V-shaped projections that fit into two small perforations in the container 3. The vertical portion 24 of the lid-lifting device 6 extends along the wall 17 of the container 3 and into a hinge 22. The portions 24, 27 of the lid-lifting device 6 are preferably (but not limited to) made of metal. The top end 25 of the portion 24 fits into the hinge through a channel 23, depicted in FIG. 3, infra, and described in associated text, herein. When the user applies pressure to the pedal 7, the portion 27 of the lid-lifting device 6 is mobilized like a see-saw. The Z-shaped portion 27 pushes the portion 24 upward, thus opening the hinge 22, as well as the lid 1.

A user steps on the pedal 7 to open the lid 1 and deposits trash into the liner 5. The lid 1 closes when the user releases the pedal 7. The user may compress trash (when the lid 1 is closed) by manually pressing the top horizontal plate 10 of the compressing device 2. The compressing device 2 returns to its resting position when the user releases it by removing his/her hand from the top horizontal plate 10. When the compressing device 2 returns to its resting position, it aligns or is flush with the top 21 of the lid 1 creating a cover for the lid 1.

Figure 3:
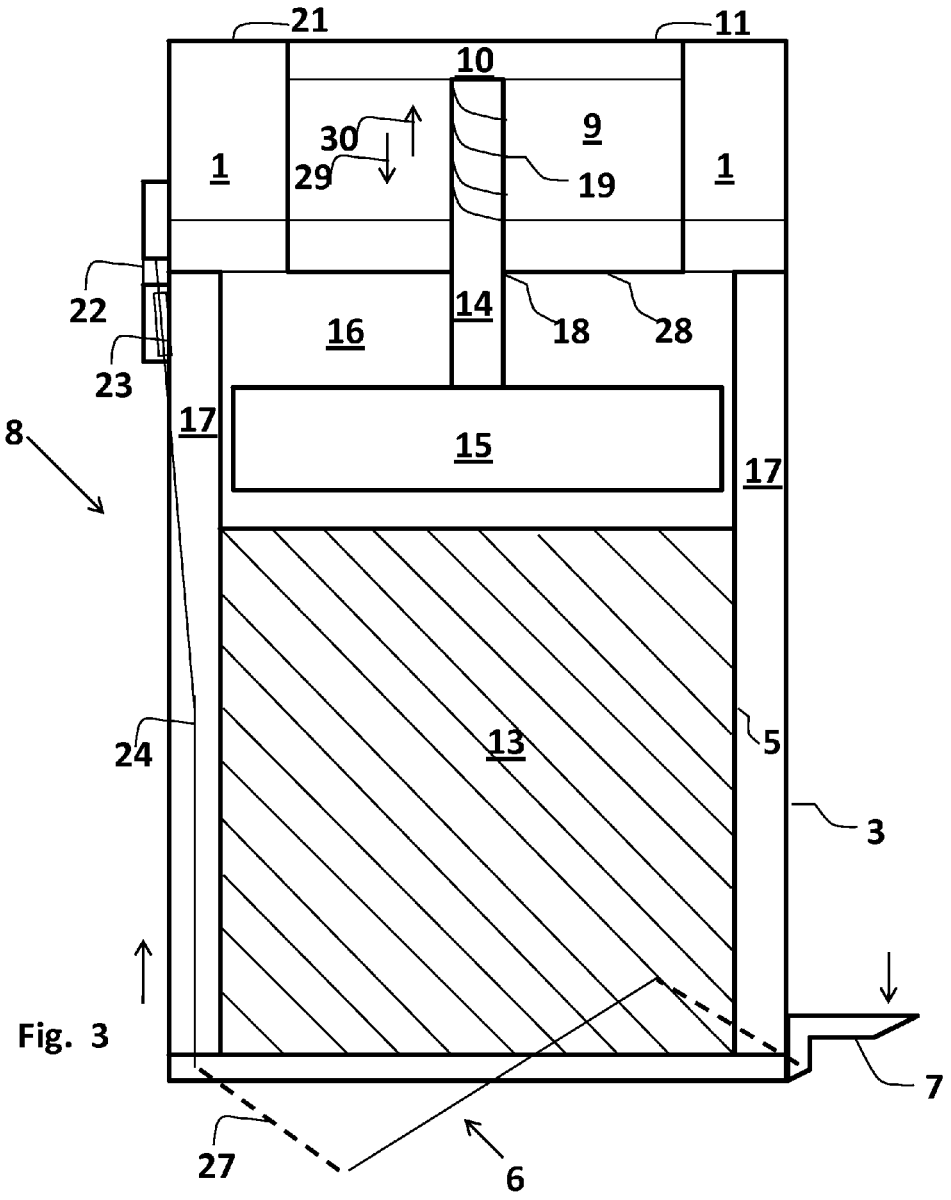
FIG. 3 depicts a longitudinal cross-sectional view of the an apparatus for compressing trash, taken along line 3-3, depicted in FIG. 2, in accordance with embodiments of the present invention.

FIG. 3 depicts a longitudinal cross-sectional view of the apparatus 8 for compressing trash, taken along line 3-3, depicted in FIG. 2. The apparatus 8 for compressing trash may have an external pedal 7 at the base 4 of the container 3. This pedal 7 may be used to open the lid 1 located at a top of apparatus 8 for compressing trash, by rotating about hinge 22.

A liner 5 or bucket inside apparatus 8 for compressing trash may be a receptacle for trash bags.

The compressing device 2 comprises an elongated rod 14 operably coupled at each end to top and bottom horizontal plates 10, 15, and a suspension device 19, e.g. a spring, entwined around the rod 14. The top and bottom horizontal plates 10, 11 are slidably displacable in unison in directions represented by arrows 29, 30 in bore 9 of the lid land bore 16 of the container liner 5. The rod goes through a small hole 18 at the bottom of lid 1, and the suspension device 19, e.g. a spring, sits on the bottom of the lid 1 (the suspension device 19 does not go through that hole 18). The top plate 10 creates a cover for the lid 1. The bottom plate 15 pushes and compresses trash 13. To compress trash 13, a user would simply push the top cover 10 down in the direction of arrow 29 while the lid 1 is in a closed position. The cover 10 will slowly spring back up in the direction of arrow 30 when the user releases it. The apparatus 8 for compressing trash can be made of stainless steel or other suitable material, and may be available in a variety of colors and sizes to suit user preferences.

Figure 4:
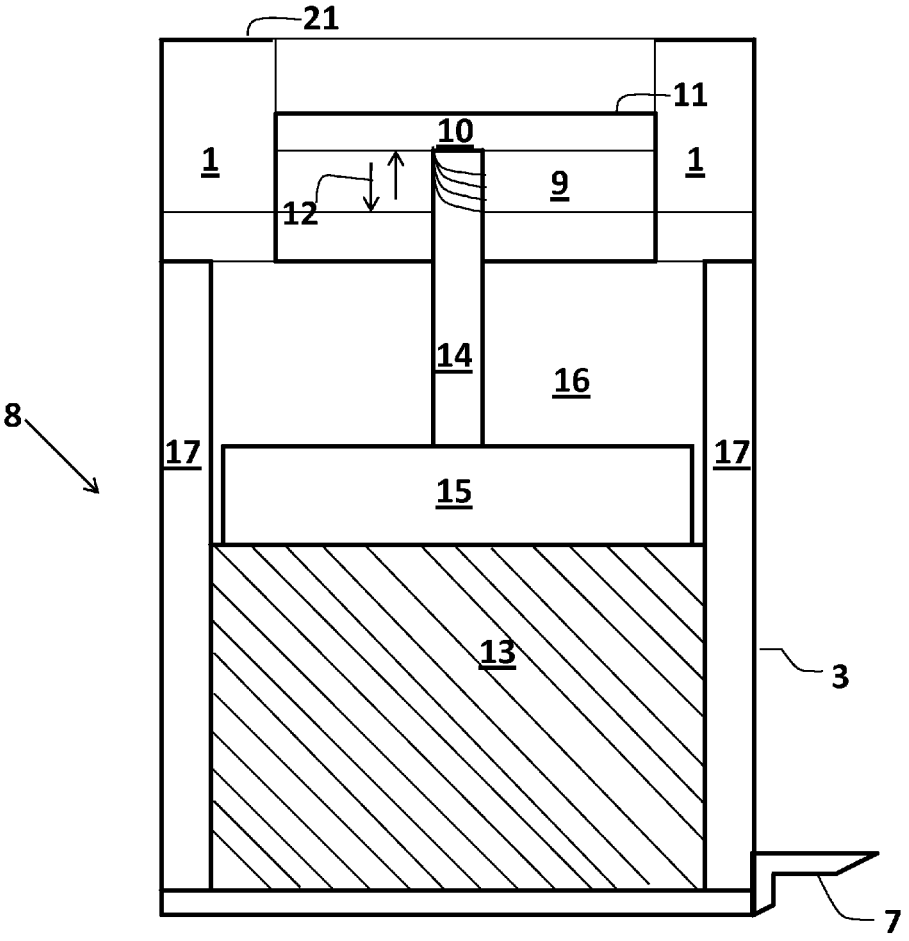
FIG. 4 depicts a longitudinal cross-sectional view of the an apparatus for compressing trash depicted in FIG. 3, after compressing the trash, in accordance with embodiments of the present invention.

FIG. 4 depicts a longitudinal cross-sectional view of the apparatus 8 for compressing trash depicted in FIG. 3, after the trash has been compressed. In one embodiment, the apparatus 8 for compressing trash is unique because you don't see the trash 13 when you compress it. The present invention also minimizes odor because the lid 1 does not need to be opened in order to compress trash. The apparatus 8 for compressing trash is easier, safer, more comfortable and user-friendly because the lid is closed when you compress trash; your only action is pushing the top horizontal plate 10 down in the direction of arrow 29. Furthermore, the apparatus 8 for compressing trash is taller than the average kitchen trash can. This minimizes bending over when compressing trash, which makes apparatus 8 for compressing trash more comfortable. Lastly, the top horizontal plate 10 of apparatus 8 for compressing trash has a mound 11 around the perimeter of the top horizontal plate 10 where your hand rests as you compress trash 13. The mound 11 around the perimeter of the top horizontal plate 10 is a safety feature that prevents a user's fingers from being caught in the lid 1 as a user compresses the trash 13.

The compressing device 2 may be more durable because it is made with a metal rod, metal spring, and metal/plastic horizontal plates. This is more durable than compression devices of other trash compactors that use baffles made of corrugated silicone or rubber that may tear and wear out over time. A baffle may be subject to losing its folds and be detached from the lid over its duty cycle as it is repeatedly compressed/expanded. The folds of the baffle could even become inverted in the opposite direction over the duty cycle, making it eventually useless. The compressing device 2 is unique and novel because it isn't attached to the lid 1 at all. Instead, it is supported by a suspension device 19 running along the rod of the compressing device 2, between the top and bottom horizontal plates 10, 15. Consequently, there is no need for a user to physically pull the baffle back up into the lid 1 after compressing the trash. Instead, the compressing device 2 returns to being flush with the top of the lid 1 by antiparallel forces exerted by the suspension device 19, e.g. a spring. Hereinafter, unless otherwise defined, the term "antiparallel" when referring to forces exerted by the suspension device 19, e.g. a spring, means parallel but oppositely directed forces exerted by the, suspension device 19, e.g. a spring.

The apparatus 8 for compressing trash is able to compact twice the volume of household trash bags, effectively doubling their capacity.

The container 3 is a receptacle made of stainless steel or high strength and impact resistant plastic, e.g. fiber reinforced thermoplastic or thermoset composites. Alternatively, it could be made of any hard material, including but not limited to plastic. The container 3 is preferably shaped as a bell-shaped cylinder, but could take any other shape including but not limited to a straight cylinder. It is preferably (but not limited to) between about 1 and 4 feet high, and is more preferably about 2 feet high. The container 3 is preferably (but not limited to) between about 6 and 24 inches wide, and is more preferably about 12 inches wide. The lid 1 is a hinged cover for the container 3. The lid 1 is preferably made of stainless steel, but it could be made of any hard material, including but not limited to plastic. The lid 1 is preferably (but not limited to) shaped as a cylinder. The lid 1 is preferably (but not limited to) between about 3 to 10 inches high, and is more preferably about 7 inches high. The diameter of the lid 1 is sized to accommodate the container 3, the liner 5 and the compressing device 2. The lid-lifting device 6 allows a user to step on an external pedal 7 to open the lid 1. The lid 1 closes when the user releases the pedal 7. The lid-lifting device 6 is housed inside the container 3, and it is preferably (but not limited to) made of metal. The pedal 7 is preferably (but not limited to) made of metal. The pedal 7 could be made of a combination of materials. The pedal 7 is preferably (but not limited to) shaped as a square. The pedal 7 is preferably (but not limited to) between about 1 and 8 inches in diameter, but it is more preferably about 4 inches in diameter. The compressing device 2 may be a spring coil mechanism that compresses trash inside the liner 5. It is housed inside the lid 1. To compress trash, a user would simply push the top plate element of this device 2 using his/her hand while the lid 1 is closed. The compressing device 2 returns to its resting position when the user stops pushing. This device 2 is preferably (but not limited to) made of metal. The compressing device 2 is preferably (but not limited to) between about 1 and 12 inches high, and is more preferably about 9 inches high. It could be shaped and sized to fit in all types, shapes and sizes of indoor and outdoor trash receptacles, including but not limited to infrared receptacles, touch-less receptacles, motion sensor receptacles, open or no-lid receptacles, plastic receptacles, receptacles with removable lids, recycling receptacles, in-cabinet receptacles, bullet open receptacles, swing top receptacles, butterfly receptacles, dual or multi-compartment receptacles, wall-mounted receptacles, grocery bag holders, hexagon-shaped receptacles, curved receptacles, and cylindrical receptacles. The liner 5 is a bucket that fits inside the container 3 to hold trash. It is preferably (but not limited to) made of plastic. The liner 5 is preferably without a handle, but it could have a handle that allows a user to easily lift it. The liner 5 is preferably shaped and sized to accommodate the container 3. The liner 5 is preferably (but not limited to) shaped as a cylinder. The base 4 is the bottom support for the container 3 and for the lid-lifting device 6. The base 4 is preferably (but not limited to) shaped as a circle. It is preferably (but not limited to) between about 1 inch and 2 inches high, and is more preferably about 1 inch high. It is preferably (but not limited to) between about 6 and 24 inches in diameter, and is more preferable about 13 inches in diameter. The base 4 could be sized and shaped to fit any types of trash receptacles. The base 4 is preferably (but not limited to) made of rubber.

The lid 1, the compressing device 2, the container 3, and the liner 5 are necessary elements of this invention. The optional elements all provide additional features and benefits as previously described. For example, the lid-lifting device 6 and the pedal 7 provide convenience for opening the lid 1, and the base 4 provides protection and added support for the container 3.

The invention may include additional beneficial features. As discussed, the plates of the compressing device 2 may have one or multiple mounds, carvings, handles, indentations, coatings, textures, layers, projections or cleats. The compressing device 2 may have one or multiple spring coils located to the side of the rod. The rod of the compressing device 2 may be made of collapsible compartments. The compressing device 2 may be mobilized by a crank, a hydraulic device or a motor.

The compressing device 2 may, or may not, be shaped and sized to fit in all types, shapes and sizes of indoor and outdoor trash receptacles, including but not limited to infrared receptacles, touch-less receptacles, motion sensor receptacles, open or no-lid receptacles, plastic receptacles, receptacles with removable lids, recycling receptacles, in-cabinet receptacles, bullet open receptacles, swing top receptacles, butterfly receptacles, dual or multi-compartment receptacles, wall-mounted receptacles, grocery bag holders, hexagon-shaped receptacles, curved receptacles, and cylindrical receptacles.

Any connections described in this application may include any connectors, including screws, hinge, bolts, adhesives, glue etc. The lid 1 is preferably (but not limited to) connected perpendicularly to top of the container 3 by a hinge 22. It is possible that the lid isn't connected to the container at all. The lid 1 houses the compressing device 2. The lid 1, which is preferably (but not limited to) about seven inches deep, is a cylinder with a flat bottom. There is a small hole, preferably (but not limited to) about 2 inches wide, in the center of the lid's bottom. The wall of the hole is folded downward, thus creating a small tube preferably (but not limited to) about 1 inch long. The entire interior of the lid 1, including the hole, is lined with a thin layer of a soft, protective coating. The coating is preferably (but not limited to) made of rubber. The coating could be made of any soft, durable material including but not limited to plastic. The wall of the lid 1 extends downward preferably (but not limited to) about 1 inches passed the lid's bottom. The compressing device 2 is a vertical rod with a horizontal plate 10, 15 attached at each end. The rod is attached onto the centers of the plates preferably (but not limited to) by screws, but it could be attached by any connectors including but not limited to glue. There is a suspension device 19, e.g., a spring coil, entwined around the rod. The spring coil is preferably (but not limited to) made of metal. The compressing device 2 preferably isn't attached to the lid 1, but it could be attached to the lid 1 by any connector. The compressing device 2 is placed inside the lid 1 with the rod going through the small hole. The spring coil, which is slightly larger than the hole, rests on the lid's bottom. One plate 10 aligns with the top 21 of the lid 1, and the other plate 15 is below the lid's bottom. It is possible that there be one or more spring coils located to the side of the rod. It is possible that the plates have one or more mounds, carvings, handles, indentations, coatings, textures, layers, projections or cleats. It is possible that the rod be made of collapsible compartments. It is possible that the compressing device 2 is mobilized by a crank, hydraulic device or motor. Using one or more of the aforementioned possibilities is an alternative of the compressing device 2 and of the invention. The base 4 is connected to the bottom of the container 3 preferably (but not limited to) by four notches that are preferably (not limited to) indented into the base. The notches are open outwardly. The bottom edge of the container 3 projects inward and horizontally (as if folded in). The projection is preferably (but not limited to) about ½ inch long. That projection fits into the notches of the base 4 to connect the container 3 to the base 4. The base 4 could be attached to the container 3 by any other connectors, including but not limited to screws. The liner 5 is preferably not attached to any part of this invention, as it is preferably a removable bucket that fits inside the container 3. But the liner 5 could be attached to any part of this invention with any connectors, including but not limited to screws.

The invention collects and compresses trash. A user steps on the pedal 7 to open the lid 1 and deposits trash into the liner 5. The lid 1 closes when the user releases the pedal 7. The user may compress trash (when the lid 1 is closed) by manually pressing the top plate of the compressing device 2. The container 3 holds the liner 5, holds part of the lid-lifting device 6, and is attached to the lid 1. The base 4 supports and protects the bottom of the container 3. The base 4 also holds part of the lid-lifting device 6.

This invention could be made in a manufacturing plant by making each element separately and then attaching them accordingly, using appropriate connectors. The invention may have artistic, creative features including (but not limited to) inscription of shapes, pictures, drawings, outlines and/or messages. Also, all or part of the invention may have various colors.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

We claim:

1. An apparatus for compressing trash, comprising:
- a container having a liner;
- a lid comprising a first opening in a first surface opens into a bore through the lid, and a second opening in a second surface of the lid;
- a slidably displaceable compressing device, comprising:
  - a radially depending top horizontal plate,
  - a radially depending bottom horizontal plate, and
  - an elongated member, therebetween,
    - wherein the radially depending top horizontal plate is slidably displaceable inside the bore through the first surface of the lid of the container,
    - wherein the radially depending bottom horizontal plate is slidably displaceable into the liner of the container, and
    - wherein the elongated member is slidably displaceable along its longitudinal axis in the second opening in the second surface of the lid;
  - a suspension device, for suspending the compressing device, coaxially disposed about the elongated member between the radially depending top horizontal plate and the second surface of the lid,
  - wherein the suspension device suspends the slidably displaceable compressing device by generating opposing antiparallel forces substantially parallel to the longitudinal axis of the compressing device.

2. The apparatus of claim 1, wherein the container is a receptacle.

3. The apparatus of claim 1, wherein a container material is selected from the group consisting of stainless steel material and plastic material.

4. The apparatus of claim 1, wherein the container shape is selected from the group consisting of a bell-shape and a straight cylinder shape.

5. The apparatus of claim 1, wherein the container is shaped and sized to fit inside indoor and outdoor trash receptacles selected from the group consisting of infrared receptacles, touch-less receptacles, motion sensor receptacles, open or no-lid receptacles, plastic receptacles, receptacles with removable lids, recycling receptacles, in-cabinet receptacles, bullet open receptacles, swing top receptacles, butterfly receptacles, dual or multi-compartment receptacles, wall-mounted receptacles, grocery bag holders, hexagon-shaped receptacles, curved receptacles, and cylindrical receptacles.

6. The apparatus of claim 1, wherein a container height is between about 1 ft. and 4 ft.

7. The apparatus of claim 6, wherein the container height is about 2 ft.

8. The apparatus of claim 1, wherein a container width is between about 6 and 24 inches.

9. The apparatus of claim 8, wherein the container width is about 12 inches.

10. The apparatus of claim 1, wherein the lid is operably coupled to the container by a hinge.

11. The apparatus of claim 1, wherein the lid has a cylindrical shape.

12. The apparatus of claim 1, wherein lid is between about 3 to 10 inches high.

13. The apparatus of claim 1, wherein the lid is about 7 inches high.

14. The apparatus of claim 1, wherein the radially depending top horizontal plate, and the radially depending bottom horizontal plate of the compressing device fit within a cavity of the lid.

15. The apparatus of claim 1, comprising a lid-lifting device housed inside the container.

16. The apparatus of claim 15, wherein the lid-lifting device is made of metal.

17. The apparatus of claim 16, wherein a pedal is operably coupled to the lid-lifting device.

18. The apparatus of claim 17, wherein the pedal is made of metal.

19. The apparatus of claim 18, wherein the pedal is shaped as a square.

20. The apparatus of claim 17, wherein the pedal is between about 1 and 8 inches in diameter.

21. The apparatus of claim 20, wherein the pedal is about 4 inches in diameter.

22. A method for hygienically compressing trash, comprising:

providing an apparatus for compressing trash, the apparatus comprising: a container having a liner, a lid comprising a first opening in a first surface opens into a bore through the lid, and a second opening in a second surface of the lid, a slidably displaceable compressing device, and a suspension device for suspending the compressing device, wherein the compressing device comprises a radially depending top horizontal plate, a radially depending bottom horizontal plate, and an elongated member, therebetween, wherein the radially depending top horizontal plate is slidably displaceable inside the bore through the first surface of the lid of the container, wherein the radially depending bottom horizontal plate is slidably displaceable into the liner of the container, wherein the elongated member is slidably displaceable along its longitudinal axis in the second opening in the second surface of the lid; wherein the suspension device coaxially disposed about the elongated member between the radially depending top horizontal plate and the second surface of the lid, and wherein the suspension device suspends the slidably displaceable compressing device by generating opposing antiparallel forces substantially parallel to the longitudinal axis of the compressing device; and slidably displacing the compressing device to compress the trash without a user's hands physically coming in contact with the trash.

23. An apparatus for compressing trash, comprising:

a container having a liner, wherein the liner contains trash;

a lid, having a solid shape and comprising first and second surfaces, having first and second openings, therein, wherein the first and second surfaces, having the first and second openings are oppositely disposed, wherein the first opening in the first surface opens into a bore through the lid, and wherein the second opening in the second surface opens into the container;

a slidably displaceable compressing device, comprising:

a radially depending top horizontal plate, a radially depending bottom horizontal plate, and an elongated member, therebetween, wherein the radially depending top horizontal plate is slidably displaceable into the bore through the first surface of the lid, wherein the radially depending bottom horizontal plate is slidably displaceable into the liner of the container, and wherein the elongated member is slidably displaceable along its longitudinal axis in the second opening in the second surface of the lid; and a suspension device, for suspending the compressing device, coaxially disposed about the elongated member between the radially depending top horizontal plate and the second surface of the lid, wherein the suspension device suspends the slidably displaceable compressing device by generating opposing antiparallel forces substantially parallel to the longitudinal axis of the compressing device.

24. The apparatus of claim 23, wherein the suspension device is a spring.

25. The apparatus of claim 23, wherein a container material is selected from the group consisting of stainless steel material and plastic material, so the apparatus may be used indoors or outdoors.

26. The apparatus of claim 23, wherein a container material is selected from the group consisting of stainless steel material and plastic material, so the apparatus may be used indoors or outdoors.

* * * * *